US006676897B2

(12) United States Patent
Nazmy et al.

(10) Patent No.: US 6,676,897 B2
(45) Date of Patent: Jan. 13, 2004

(54) HIGH-TEMPERATURE ALLOY

(75) Inventors: Mohamed Nazmy, Fislisbach (CH); Markus Staubli, Dottikon (CH)

(73) Assignee: Alstom (Switzerland) Ltd, Baden (CH)

( * ) Notice: Subject to any disclaimer, the term of this patent is extended or adjusted under 35 U.S.C. 154(b) by 52 days.

(21) Appl. No.: 09/969,026

(22) Filed: Oct. 3, 2001

(65) Prior Publication Data

US 2003/0124021 A1 Jul. 3, 2003

(30) Foreign Application Priority Data

Oct. 4, 2000 (DE) ..... 100 49 026

(51) Int. Cl.[7] ..... C22C 14/00
(52) U.S. Cl. ..... 420/418; 148/421
(58) Field of Search ..... 420/418; 148/421

(56) References Cited

U.S. PATENT DOCUMENTS

| | | | | |
|---|---|---|---|---|
| 3,203,794 A | | 8/1965 | Jaffee et al. | |
| 4,842,820 A | | 6/1989 | Huang et al. | |
| 5,207,982 A | | 5/1993 | Nazmy et al. | |
| 5,226,985 A | | 7/1993 | Kim et al. | |
| 5,286,443 A | | 2/1994 | Nazmy et al. | |
| 5,328,530 A | | 7/1994 | Semiatin et al. | |
| 5,342,577 A | | 8/1994 | Nazmy et al. | |
| 5,370,839 A | * | 12/1994 | Masahashi et al. | 420/418 |
| H1659 H | | 7/1997 | Semiatin et al. | |
| 5,653,828 A | | 8/1997 | Zhao et al. | |
| 5,908,516 A | | 6/1999 | Nguyen-Dinh | |

FOREIGN PATENT DOCUMENTS

| | | |
|---|---|---|
| DE | 197 56 354 A1 | 6/1999 |
| DE | 199 33 633 A1 | 1/2001 |
| EP | 0 363 598 A1 | 4/1990 |
| EP | 0 405 134 A1 | 1/1991 |
| EP | 0 455 005 A1 | 11/1991 |

* cited by examiner

*Primary Examiner*—George Wyszomierski
*Assistant Examiner*—Janelle Combs Morillo
(74) *Attorney, Agent, or Firm*—Burns, Doane, Swecker & Mathis, L.L.P.

(57) ABSTRACT

The invention relates to a high-temperature alloy for a mechanically highly stressed component of a thermal machine based on doped TiAl and a method to improve a mechanical property of the alloy. The alloy has the following composition (in atomic %): 44.5 to <46 Al, 1–4 W, 0.1–1.5 Si, 0.0001–4 B, and the rest Ti and contaminations due to the manufacturing process. The alloy is characterized by improved heat resistance and ductility at high temperatures, and at the same time good oxidation and corrosion resistance.

7 Claims, 4 Drawing Sheets

HIGH-TEMPERATURE ALLOY

FIELD OF THE INVENTION

The invention relates to a high-temperature alloy for thermal machines based on intermetallic compounds that are suitable for waste-wax casting and directional solidification and that supplement conventional nickel-based super alloys.

It concerns an improvement of alloys based on an intermetallic compound of the titanium aluminide TiAl type with other additives that increase strength, toughness, and ductility as well as oxidation and creep resistance.

BACKGROUND OF THE INVENTION

Intermetallic compounds of titanium with aluminum have several interesting properties that make them attractive as construction materials in the intermediate and higher temperature range. This includes their lower density than supper alloys. However, their technical utility in the present form is adversely affected by their brittleness. This can be improved by specific additives.

It has been suggested, for example, to add alternatively Cr, B, V, Si, Ta as well as Mn, W, Mo, Nb, Hf or (Ni+Si) to reduce brittleness on the one hand and to achieve the highest possible strength in the temperature range of interest between room temperature and operating temperature on the other hand. A sufficiently high oxidation resistance also has been desired. These objectives were only partially realized, however.

Especially the heat resistance of known aluminides is falling short of desired values. In accordance with the relatively low fusion point of these materials, the strength, in particular creep resistance, in the upper temperature is insufficient.

U.S. Pat No. 3,203,794 discloses a TiAl high-temperature alloy with 37 wt. % Al, 1 wt. % Zr, and the rest Ti. The relatively small addition of Zr results in this alloy having properties comparable to pure TiAl.

EP-A1-0 363 598 discloses a high-temperature alloy based on TiAl with additives of Si and Nb, while EP-A1-0 405 134 discloses a high-temperature alloy based on TiAl with additives of Si and Cr.

However, these known, modified intermetallic compounds do not fulfill the technical requirements.

In order to improve the properties, EP-B1-0 455 005 therefore disclosed a high-temperature alloy based on doped TiAl and having the following chemical composition:

$Ti_xE1_yMe_zAl_{1-(x+Y+z)}$, whereby

E1=B, Ge or Si and Me=Cr, Mn, Nb, Pd, Ta, W, Y, Zr, and the following applies:

$0.46 \leqq x \leqq 0.54$, $0.001 \leqq y < 0.015$ for E1=Si and Me=W $0.001 \leqq y \leqq 0.015$ for E1=Ge and Me=Cr, Ta, W $0 < y \leqq 0.02$ for E1=Ge and Me=Pd, Y, Zr $0.0001 \leqq y \leqq 0.01$ for E1=B $0.01 < z \leqq 0.04$, if Me=single element, $0.01 < z \leqq 0.08$, if Me=two or more single elements and $0.46 \leqq (x+y+z) < 0.54$.

By adding W, Cr, Mn, Nb, Y, Zr, Pd to the alloy, a higher hardness and strength is achieved than with the TiAl base alloy. The addition of B increases ductility. Si increases oxidation resistance. The range of application for these modified titanium aluminides extends to temperatures between 600° C. and 1000° C.

Another improvement, especially of creep resistance and oxidation resistance, in the above described alloy is achieved if E1 is in each case a combination of two elements from the group B, Si, and Ge (DE 199 33 633.4).

SUMMARY OF THE INVENTION

A high-temperature alloy for a mechanically highly stressed component of a thermal machine has the following composition (in atomic %) based on doped TiAl:

44.5 to<46 Al,

1–4 W, 0.1–1.5 Si, 0.0001–4 B, and

Rest Ti and contaminations due to the manufacturing process.

The alloy has an Al content that is lower than in known alloys on the one hand, and, on the other hand, a significantly higher B content.

In one aspect, the combination of the mentioned alloy elements, in particular, however, the higher B contents, makes it possible to produce, on the one hand, a very fine grain both for thin and large cross-sections, and in this way to increase the strength and creep resistance and on the other hand achieve a good oxidation resistance. The reduction of the Al content in comparison to the known state of the art increases strength, but at the same time promotes a larger grain size. Boron in contrast stabilizes the grain limits, i.e., higher boron levels reduce the amount of grain enlargement.

In one embodiment, the high-temperature alloy has the following composition (in atomic %):

44.5 to<46 Al,

1–3 W, 0.4–1 Si,

1–4 B, and

Rest Ti and contaminations due to the manufacturing process.

In a further embodiment, the high-temperature alloy has the following composition (in atomic %):

45 Al,

2 W, 0.5 Si,

2 B, and

Rest Ti and contaminations due to the manufacturing process.

BRIEF DESCRIPTION OF DRAWINGS

Preferred embodiments of the invention are disclosed in the following description and illustrated in the accompanying drawings, in which.

DETAILED DESCRIPTION OF THE INVENTION

Figure 1:
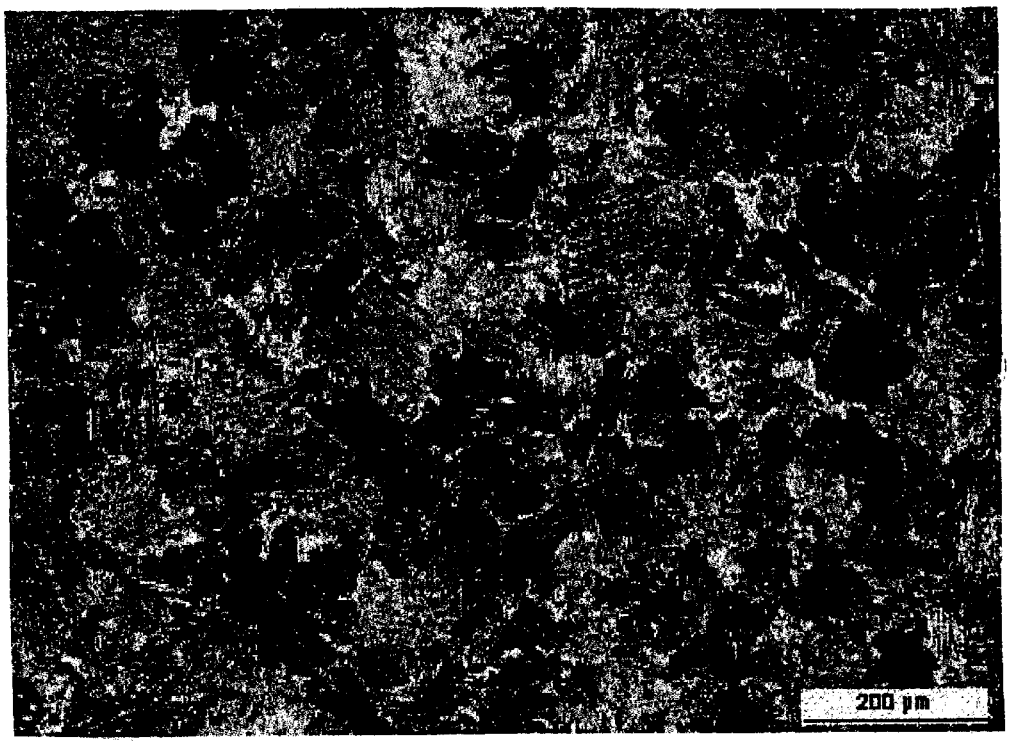
FIG. 1 shows the structure of an alloy L1 according to the invention with the following composition: Al 45 atomic %, W 2 atomic %, Si 0.4 atomic %, B 1.8 atomic %, rest Ti.
Figure 2:
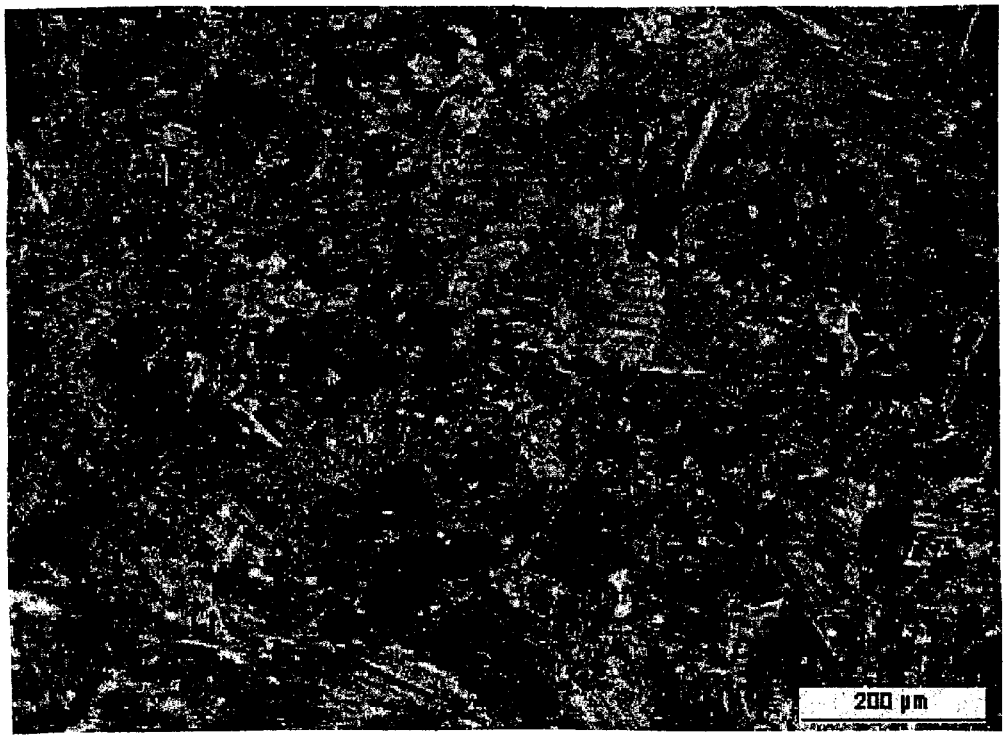
FIG. 2 shows the structure of an alloy L2 according to the invention with the following composition: Al 45 atomic %, W 2 atomic %, Si 0.47 atomic %, B 2.5 atomic %, rest Ti.
Figure 3:
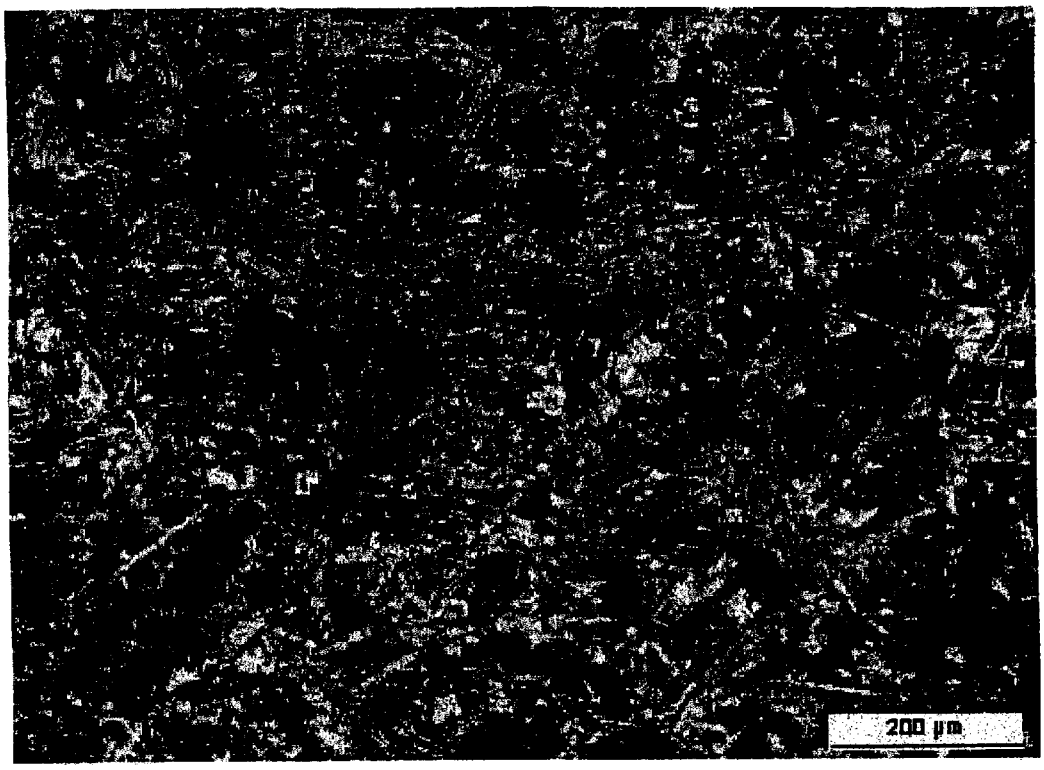
FIG. 3 shows the structure of an alloy L3 according to the invention with the following composition: Al 45 atomic %, W 1.9 atomic %, Si 0.46 atomic %, B 3.5 atomic %, rest Ti.
Figure 4:
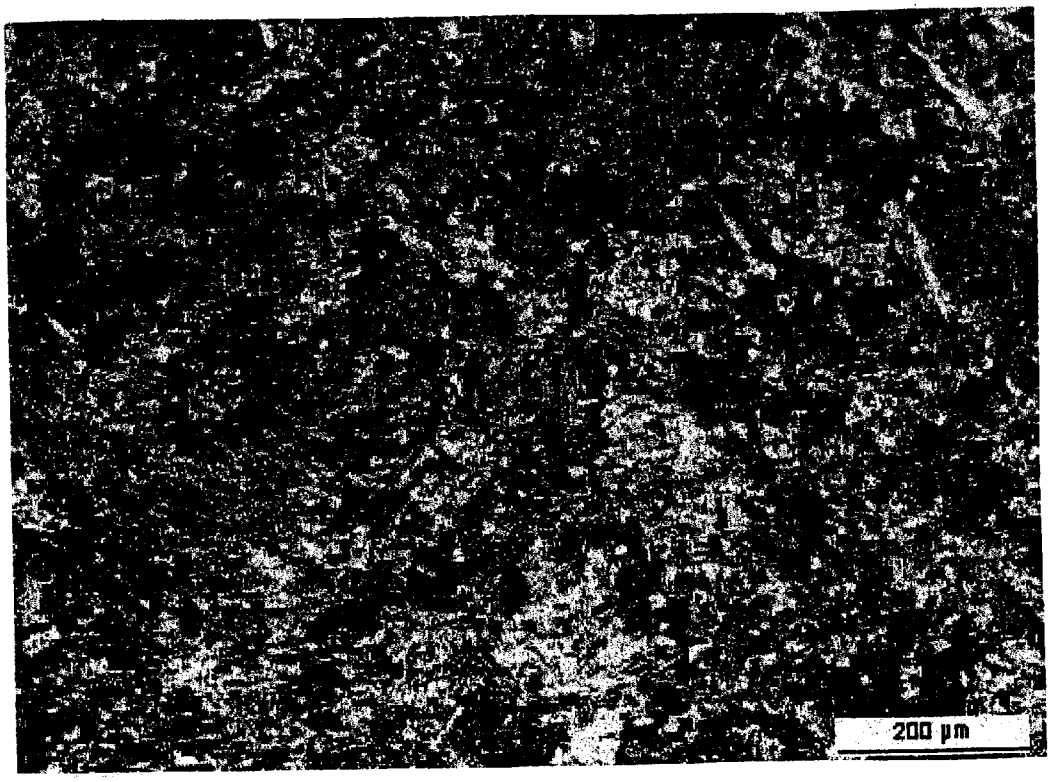
FIG. 4 shows the structure of an alloy L4 according to the invention with the following composition: Al 44.9 atomic %, W 1.9 atomic %, Si 0.46 atomic %, B 4 atomic %, rest Ti.
Figure 5:
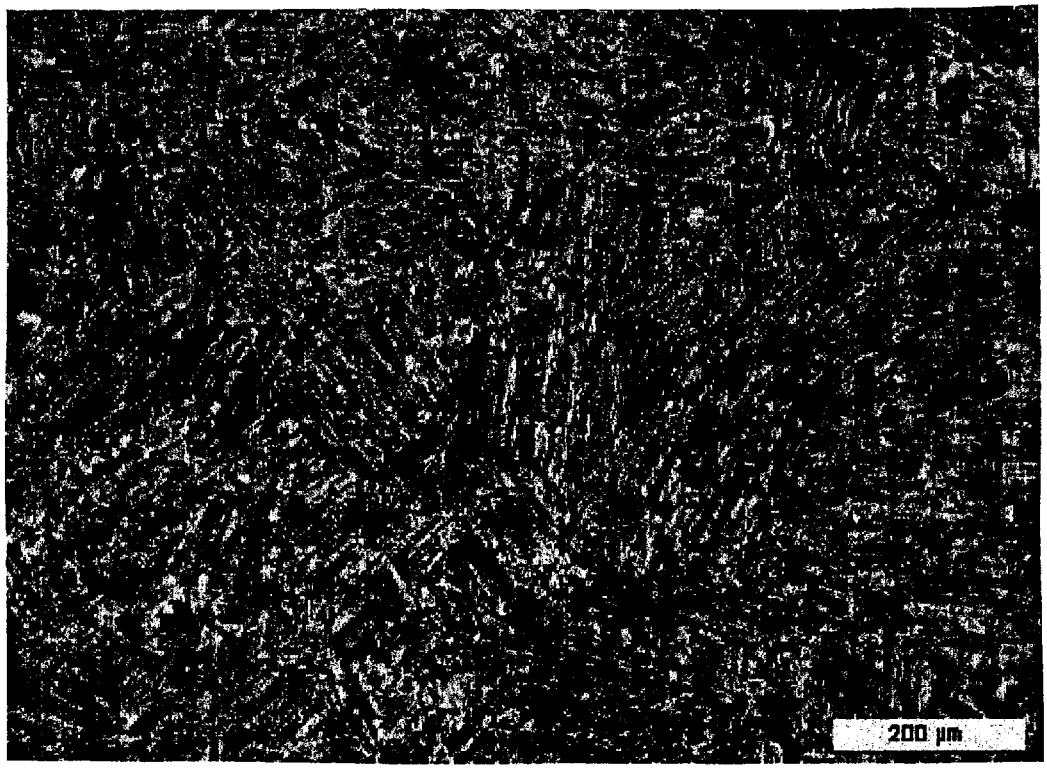
FIG. 5 shows the structure of a control alloy V1 with the following composition: Al 46 atomic %, W 2 atomic %, Si 0.48 atomic %, B 0.7 atomic %, rest Ti.
Figure 6:
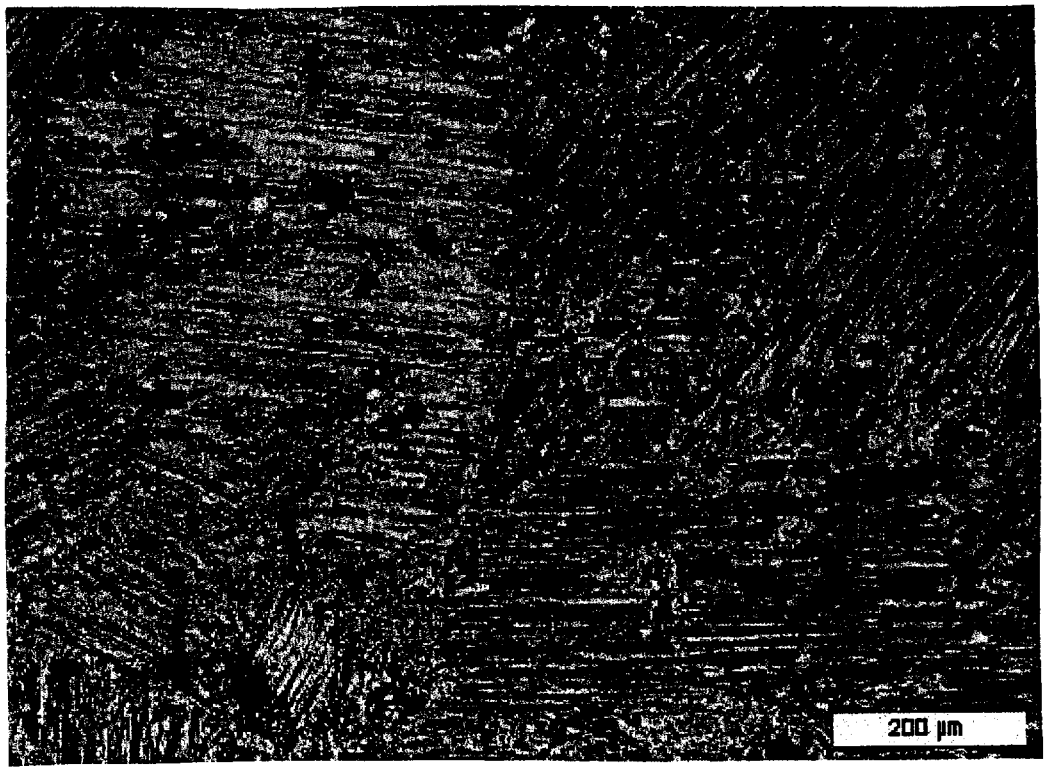
FIG. 6 shows the structure of a control alloy V2 with the following composition: Al 47 atomic %, W 2 atomic %, Si 0.5 atomic %, rest Ti.

The invention improves a TiAl doped high-temperature alloy. It is based on a light alloy with improved heat resistance and ductility at high temperatures (in the range from 600 to 1000° C.) and good oxidation and corrosion resistance that is well-suited for directional solidification or waste-wax casting and essentially consists of an intermetallic compound with a high fusion point.

The following explains the invention in more detail, using several exemplary embodiments and FIGS. 1 to 7.

In an arc furnace, under argon as a protective gas, alloys with the following composition (numbers in atomic %) were melted, whereby L1, L2, L3, and L4 stand for alloys according to the invention, and V1 and V2 are control alloys:

| Alloy | Ti | Al | W | Si | B |
|---|---|---|---|---|---|
| L1 | rest | 45 | 2 | 0.40 | 1.8 |
| L2 | rest | 45 | 2 | 0.47 | 2.5 |
| L3 | rest | 45 | 1.9 | 0.46 | 3.5 |
| L4 | rest | 44.9 | 1.9 | 0.46 | 4.0 |
| V1 | rest | 46 | 2 | 0.48 | 0.7 |
| V2 | rest | 47 | 2 | 0.50 | 0 |

The starting materials are the individual elements with a purity of 99.99%. The molten mass was cast to form a blank with a diameter of approximately 50 mm and a height of approximately 70 mm. These blanks were again melted under protective gas, and, again under protective gas, were forced to solidify in the form of rods with a diameter of approximately 9 mm and a length of approximately 70 mm. These rods then underwent HIP (HOT ISOSTATIC PRESSING) and a thermal treatment, and were then processed into tensile test samples. The HIP treatment was performed for 4 hours at a temperature of 1,260° C. and a pressure of 172 MPa. The heat treatment was performed under protective gas with the following parameters: 1,350° C./1 h+1,000° C./6 h.

Further improvement of the mechanical properties by optimizing the thermal treatment is possible, as is an improvement by directional solidification, for which such alloys are particularly suitable.

The addition of W results in an increase in strength over pure TiAl alloys, but to a reduction in ductility. B increases ductility, and Si the oxidation resistance.

FIGS. 1 to 6 show the structure of alloys L1, L2, L3, L4, as well as of V1 and V2.

The structure of the alloys according to the invention L1, L2, L3, and L4 (FIG. 1 to 4) has a significantly smaller grain than the structure of control alloy V1 (FIG. 5) that is alloyed with lower boron contents, or the alloy V2 that does not contain any boron.

Figure 7:
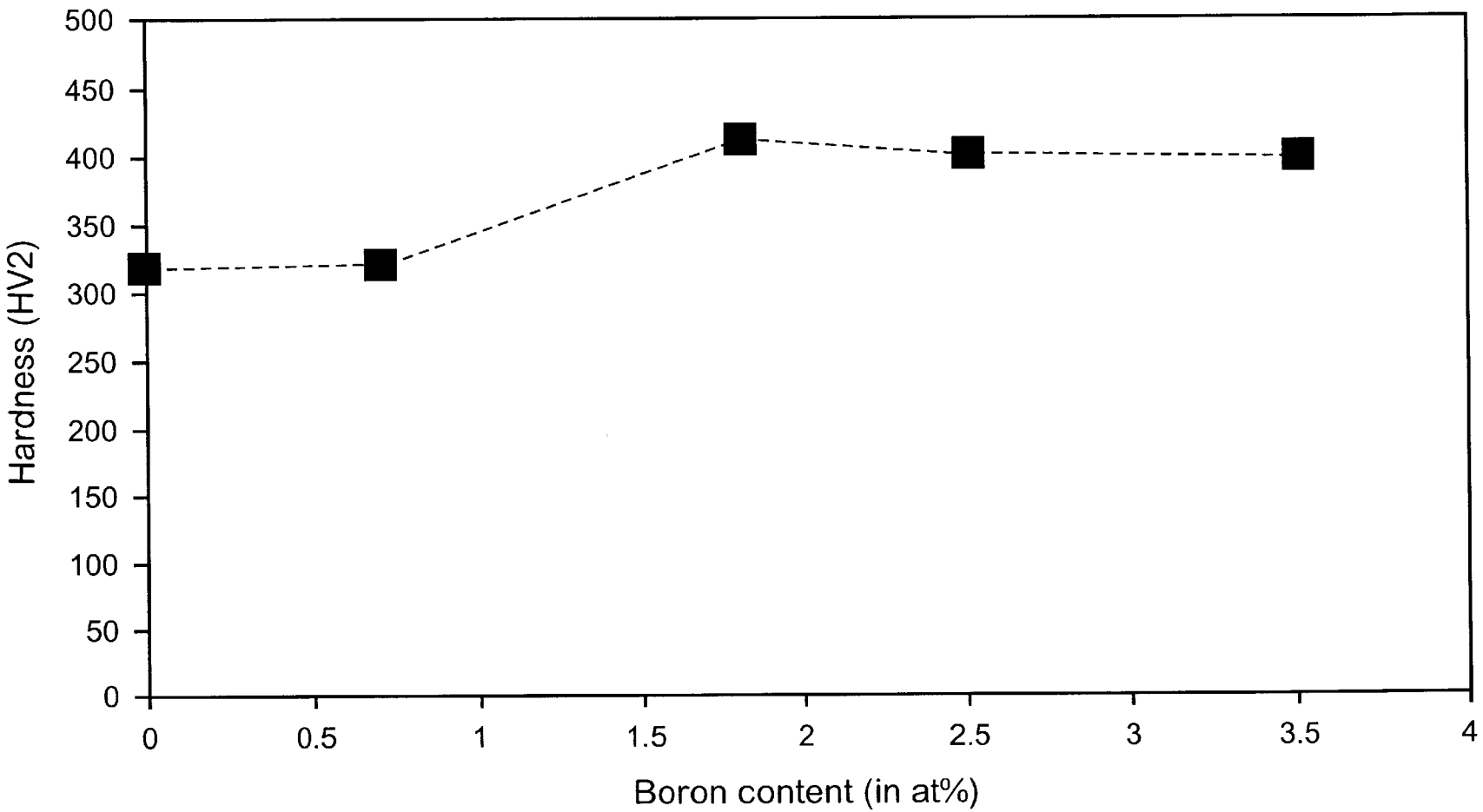
FIG. 7 shows an illustration of the hardness in relation to the boron content.

FIG. 7 shows a diagram of the hardness values in relation to the boron content for the alloys according to the invention L1, L2, and L3, as well as for the control alloys V1 and V2. Alloys L1, L2, and L3 hereby show a greater hardness than the control alloys. The alloy L1 according to the invention with 1.8 atomic % of boron shows particularly good hardness values.

These excellent properties can be attributed to the higher concentration of the alloy element B. By adding 2 atomic % of B, practically all of the ductility losses due to the W are compensated. No higher additions than 4 atomic % of B are necessary.

The range of use for the modified titanium aluminides advantageously extends over a temperature range between 600 and 1,000° C.

Naturally, this invention is not limited to the shown exemplary embodiments.

What is claimed is:

1. A high-temperature alloy for a mechanically highly stressed component of a thermal machine based on doped TiAl, the alloy consisting eventually of (in atomic %):

44.5 to<46 Al;

1–3 W;

0.4–1 Si;

1–4 B; and balance Ti and contaminations due to the manufacturing process.

2. The high-temperature alloy as claimed in claim 1, wherein the alloy has a Vickers hardness of greater than 350.

3. The high-temperature alloy as claimed in claim 1, wherein the alloy consist essentially of (in atomic %):

45 Al;

2 W;

0.5 Si;

2 B; and balance Ti and contaminations due to the manufacturing process.

4. The high-temperature alloy as claimed in claim 1, wherein the alloy consist essentially of (in atomic %):

44.5 to<46 at % Al;

1.9–2 at % W;

0.4–0.47 at % Si;

1.8–4.0 at % B; and balance Ti.

5. A high-temperature alloy for a mechanically highly stressed component of a thermal machine based on doped TiAl, the alloy comprising (in atomic %):

45 Al;

2 W;

0.5 Si;

2 B; and balance Ti and contaminations due to the manufacturing process.

6. A high-temperature alloy based on doped TiAl, the alloy comprising:

44.5 to<46 at % Al;

1.9–2 at % W;

0.4–0.47 at % Si;

1.8–4.0 at % B; and balance Ti.

7. The alloy of claim 6, wherein the alloy has a Vickers hardness of greater than 350.

* * * * *